252-147 AU 166 EX
10/26/82 XR 4,356,148

United States Patent [19]

Kagawa et al.

[11] 4,356,148

[45] Oct. 26, 1982

[54] METHOD FOR PREVENTING CORROSION AND HYDROGEN EMBRITTLEMENT OF TANTALUM-MADE EQUIPMENT HANDLING HOT CONCENTRATED SULPHURIC ACID THEREIN

[75] Inventors: Naohiko Kagawa; Katsumi Yamamoto, both of Yokohama; Rin Sasano, Tokyo; Takao Kusakabe, Kawasaki; Yasuhiro Moriya, Yokohama, all of Japan

[73] Assignee: JGC Corporation, Tokyo, Japan

[21] Appl. No.: 243,399

[22] Filed: Mar. 13, 1981

[30] Foreign Application Priority Data

Mar. 24, 1980 [JP] Japan ..... 55-36218

[51] Int. Cl.[3] ..... C23F 11/04; C23F 11/18

[52] U.S. Cl. ..... 422/9; 252/147; 422/7

[58] Field of Search ..... 422/7, 9, 12; 252/146, 252/147; 423/522

[56] References Cited

U.S. PATENT DOCUMENTS 4,154,791 5/1979 Howells et al. ..... 422/12

FOREIGN PATENT DOCUMENTS 2807360 4/1979 Fed. Rep. of Germany ..... 422/12
53-88500 3/1978 Japan .

*Primary Examiner*—Barry S. Richman
*Attorney, Agent, or Firm*—Jordan and Hamburg

[57] ABSTRACT

A method for preventing the corrosion and hydrogen embrittlement of equipment made of tantalum handling therein hot concentrated sulphuric acid at 200° C. or higher, characterized in that at least one oxidizer selected from the group consisting of nitric acid, nitrogen oxides, ferric ion, cupric ion, stannic ion or plumbic ion is incorporated in the sulphuric acid.

2 Claims, 3 Drawing Figures

Figure 1:
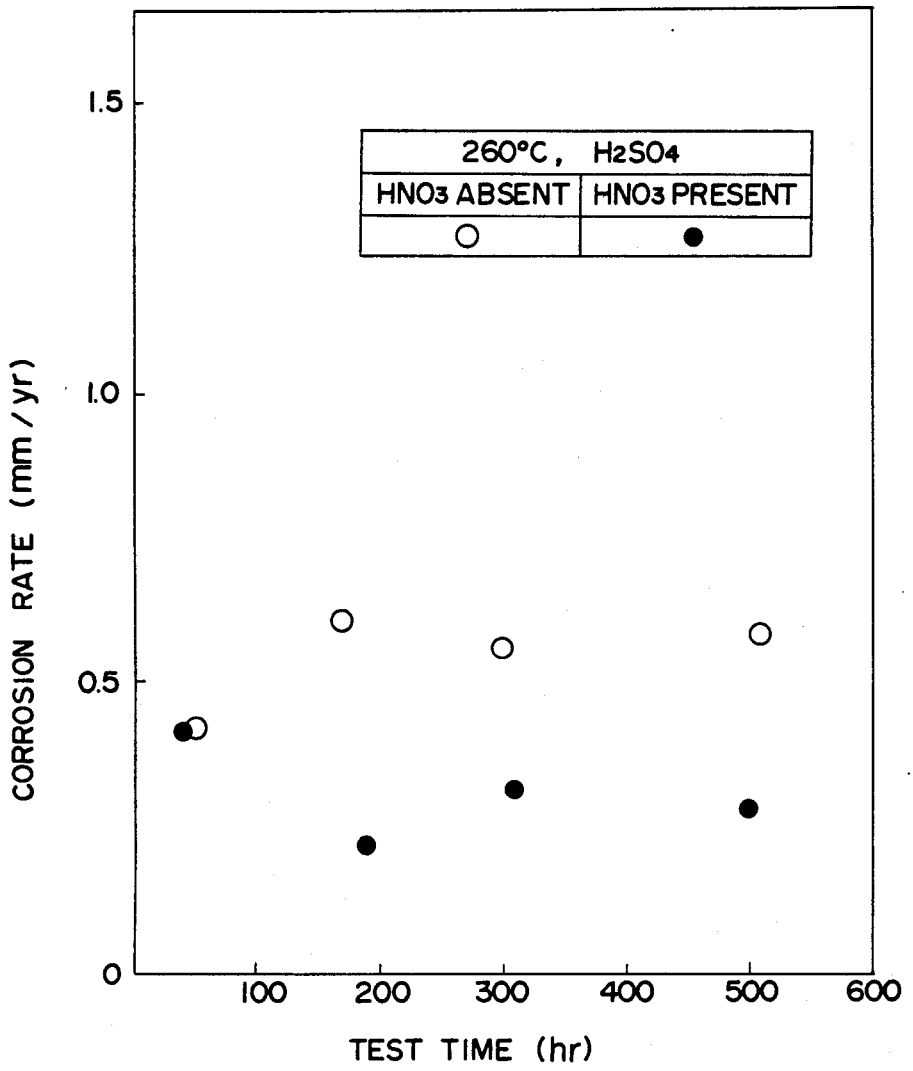

METHOD FOR PREVENTING CORROSION AND HYDROGEN EMBRITTLEMENT OF TANTALUM-MADE EQUIPMENT HANDLING HOT CONCENTRATED SULPHURIC ACID THEREIN

The present invention relates to a method for preventing corrosion and hydrogen embrittlement of equipment made of tantalum in which concentrated sulphuric acid at 200° C. or higher is handled.

As methods for decomposing various kinds of radioactive sludges and used ion-exchange resins after their use in treating radioactive materials, an acid digestion process has recently been employed for decomposing them in hot concentrated sulphuric acid at 200° C. or higher. For the construction material of equipment in which the decomposing treatment is effected, ordinary metals are not applicable for lack of their corrosion resistance to hot concentrated sulphuric acid and only tantalum has been known to be practically usable.

However, even tantalum has a good corrosion resistance to hot concentrated sulphuric acid as far as its temperature is not raised beyond about 200° C. and the metal will be corroded at a considerable rate and simultaneously tend to absorb hydrogen produced by the corrosion reaction thereby to be embrittled by the hydrogen.

An object of this invention is to provide a method for preventing equipment made of tantalum from its corrosion and hydrogen embrittlement when contacted with concentrated sulphuric acid at above approximately 200° C. by means of adding to the hot acid an oxidizer soluble therein in a case where such hot concentrated sulphuric acid is handled in such equipment.

In cases where equipment handling hot concentrated sulphuric acid therein is designed using tantalum as a construction material, a problem as to general corrosion (including surface corrosion) of the equipment will comparatively easily be solved by using tantalum which is thick with a sufficient allowance for corrosion, while a problem as to hydrogen embrittlement accompanied with the corrosion will hardly be solved with effectiveness by employing the same means as above.

Thus, in an attempt to solve the latter problem, there was once proposed a method of spot-welding platinum on tantalum to allow hydrogen to be produced at the spot-welded platinum (Corrosion, vol. 17, 379t (1961)). The method so proposed is little feasible since industrial equipment for carrying out said method would cost very much in view of the fact that the equipment requires a large amount of the expensive noble metal.

In contrast, the present invention contemplates to simultaneously and effectively solve said two problems raised from the use of tantalum as material for equipment handling therein hot concentrated sulphuric acid at a temperature above 200° C. only by adding to the hot acid at least one oxidizer selected from the group consisting of nitric acid, vapourized nitric acid, nitrogen oxides, ferric salts, cupric salts, stannic salts and plumbic salts. The process of the present invention will be remarkably effective in preventing hydrogen embrittlement of tantalum thereby incurring very great benefits from the view point of plant economy.

According to the present invention, there may be effectively prevented the general corrosion and hydrogen embrittlement of various equipment, such as a column, tank, heat exchanger, piping, valve, agitator and pump, which is contacted with hot sulphuric acid at 200° C. or higher; furthermore, equipment to which this invention is more practically applicable may be those in which radioactive resins and/or various radioactive sludges containing organic materials, discharged from nuclear facilities and the like, are decomposed in hot concentrated sulphuric acid to reduce the volume of solid waste. In cases of radioactive solid waste, conventional incineration methods usually employed to reduce the volume of solid waste are not applied since they will have a risk of scattering radioactive dust and ashes when radioactive solid waste is treated thereby and, therefore, methods for decomposing radioactive solid waste in hot concentrated sulphuric acid have been recommended. The present invention is very effective in protecting equipment made of tantalum from corrosion when carrying out such decomposing methods thereby.

The concentrated sulphuric acid used in the process of this invention is such that its boiling point at ambient pressure is 200° C. or higher. The reason for this is that a problem as to the general corrosion and hydrogen embrittlement of the material of equipment for the decomposition is comparatively seldom raised from the view-point of the practical use of the equipment without employing the present invention as far as the construction or lining material of the equipment is tantalum and the temperature of sulphuric acid used is lower than 200° C. In the practice of the present invention, the concentrated sulphuric acid may be used at a temperature at which it boils at atmospheric pressure or at a temperature which is lower than its boiling point at atmospheric pressure but is in the range of 200° C. or higher. The oxidizers added to hot concentrated sulphuric acid in the practice of the present invention include nitric acid, vapourized nitric acid and nitrogen oxide gases as well as ferric, cupric, stannic and plumbic ions. They may be used alone or in combination. The concentration of nitric acid used is not particularly limited, but it is desirable to use highly concentrated nitric acid (having a concentration such as 98 wt.%) as far as possible since the more dilute the acid is, the more heat it requires in order to evaporate the water contained in it. As is seen from this, vapourized nitric acid or nitrogen oxide gases (such as $NO_2$) produced by heating nitric acid may be introduced into concentrated sulphuric acid by the use of a suitable means thereby to obtain the same effects as concentrated nitric acid.

The metallic compounds which provide said metal ions in concentrated sulphuric acid, include ferric compounds such as $Fe_2(SO_4)_3$, $Fe(NO_3)_3$ and $FeCl_3$, cupric compounds such as $CuSO_4$, stannic compounds such as $Sn(SO_4)_2.2H_2O$, and plumbic compounds such as $Pb(SO_4)_2$. They may be used alone or in combination. They are originally sparingly soluble in concentrated sulphuric acid and, therefore, no particular upper limit is set to the amount of these oxidizers added. However, they may preferably be added in an amount by weight of about 4% at most while they may preferably be always present in an amount by weight of at least 0.001% in concentrated sulphuric acid. For this purpose, it is desirable that the oxidizers be added not only initially but also additionally. Particularly, it is desirable that equipment for carrying out the present invention be provided with a suitable means for additionally supplying the oxidizer in cases where nitric acid or vapourized nitric acid is used as the oxidizer since it is practically difficult to allow the oxidizer to be always present in a concentration above a predetermined level in the sulphuric acid without additional supply of the oxidizer after the initial supply thereof.

Figure 2:
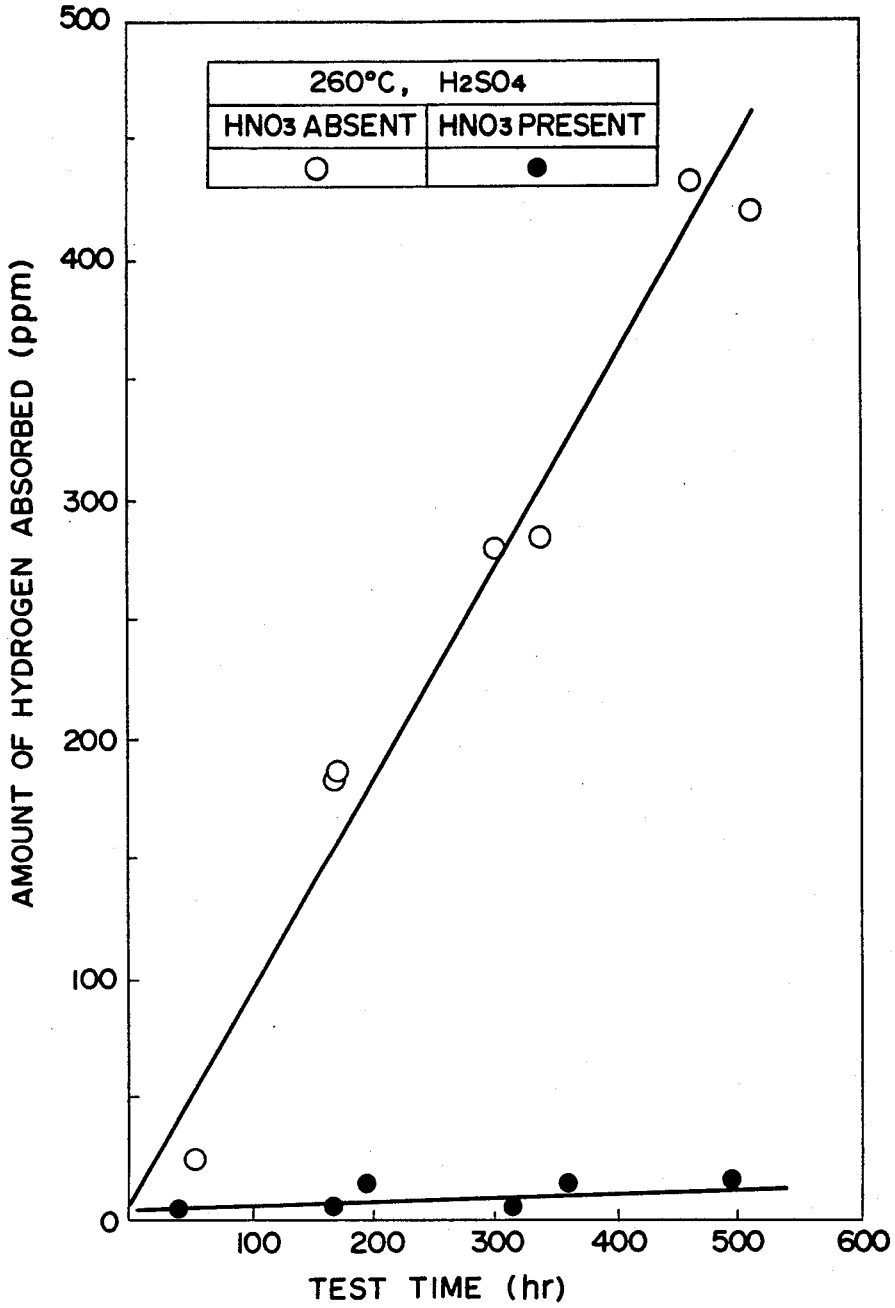
Figure 3:
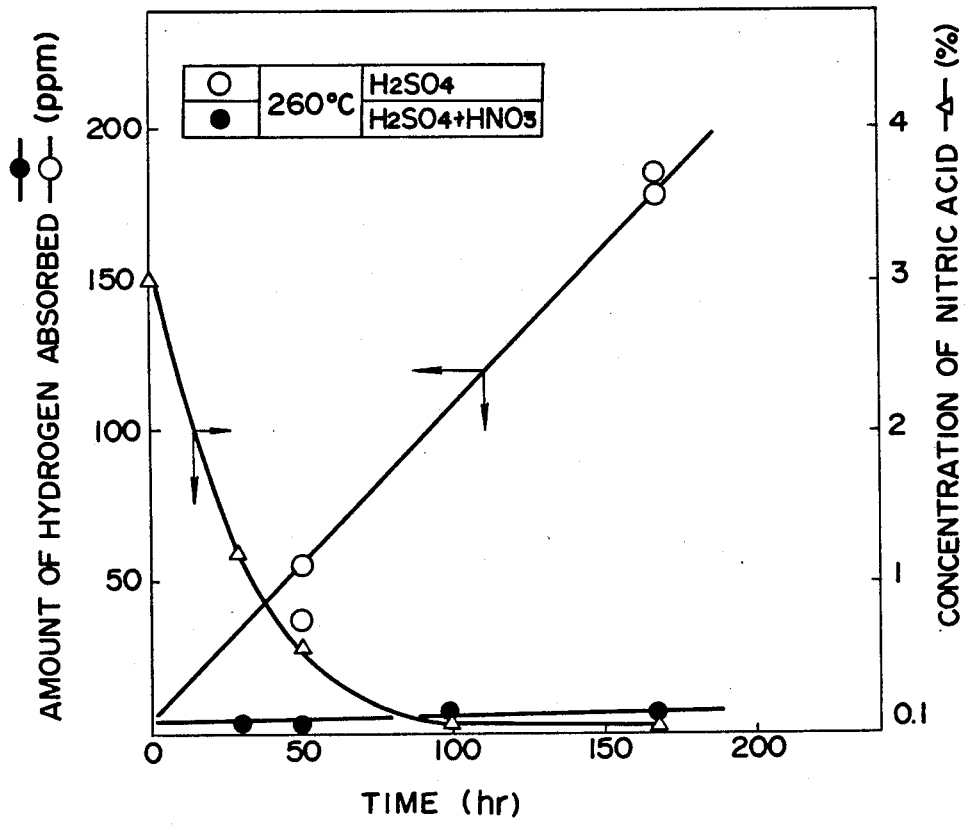

In the accompanying drawing,

FIG. 1 shows the effect of nitric acid on the corrosion rate of tantalum immersed in sulphuric acid (91 wt.% conc.) at 260° C. incorporated with the nitric acid;

FIG. 2 shows the effect of nitric acid on the amount of hydrogen absorbed on tantalum immersed in sulphuric acid (91 wt.% conc.) at 260° C. incorporated with the nitric acid; and FIG. 3 shows the relationship between the amount of hydrogen absorbed on tantalum immersed in sulphuric acid at 260° C. incorporated with nitric acid and the concentration of the nitric acid incorporated in the sulphuric acid.

The present invention will be better understood by the following Examples.

EXAMPLE 1

Tantalum to be tested here was annealed at 1200° C. in a $10^{-4}$ Torr atmosphere and had the chemical composition shown in Table 1. The specimen thus obtained was 80 mm long, 10 mm wide and 2 mm thick in size and was introduced into 1.5 l of hot concentrated sulphuric acid boiling at a temperature of 260° C., after which the whole was continuously incorporated with concentrated nitric acid (98 wt.% conc.) at a feeding rate of 30 ml/hr to investigate how general corrosion and hydrogen absorption of the tantalum progressed.

For comparison, the procedure of the above Example 1 was followed except that the concentrated nitric acid was not incorporated.

The results are as shown in FIGS. 1 and 2. It is seen from FIG. 1 that the corrosion rate of tantalum in conc. sulphuric acid incorporated with conc. nitric acid is about a half of that of tantalum in conc. sulphuric acid alone. It is also seen from FIG. 2 that the amount of hydrogen absorbed on the tantalum in conc. sulphuric acid incorporated with conc. nitric acid is remarkably small as compared with that in conc. sulphuric acid alone.

The specimens of tantalum already subjected to the corrosion test were further subjected to a bend test with the results being shown in Table 2. This table shows that the tantalum specimen treated in the conc. sulphuric acid alone produced cracks caused by the hydrogen embrittlement only 168 hours after the start of the corrosion test, while those treated in the conc. sulphuric acid incorporated with the conc. nitric acid produced no cracks at all even 500 hours after the start of the corrosion test.

TABLE 1

Chemical Composition (except tantalum) of Tantalum Tested

| | C | O | N | H | Nb | Fe | Ti | W (ppm) | Si | Ni |
|---|---|---|---|---|---|---|---|---|---|---|
| Composition of tantalum tested | 10 | 150 | 25 | <10 | 450 | <10 | 9 | 230 | 50 | 10 |
| Composition of tantalum prescribed by JIS (Japanese Industrial Standard) | <300 | <300 | <100 | <100 | <1000 | <200 | <100 | <300 | <200 | <200 |

TABLE 2

Results of Bend Test of Tantalum Specimens After Their Corrosion Test

| Test temperature | 260° C. | | | | | | | |
|---|---|---|---|---|---|---|---|---|
| Corrosion test solution | $H_2SO_4$ | | | | $H_2SO_4 + HNO_3$(2) | | | |
| Corrosion test time (hr) | 50 | 168 | 300 | 500 | 50 | 168 | 300 | 500 |
| Bend test(1) | ○ | ● | ● | ● | ○ | ○ | ○ | ○ |

(1) ○- No cracks,
● - Cracks occurred.
(2)$HNO_3$ - Continuously fed at a rate of 30 ml/hr.
Bend test conditions:
Bend speed: 2 mm/min.
Bend radius: 6 mm
Temp.: Room temperature

EXAMPLE 2

To investigate the behavior of hydrogen embrittlement of tantalum, immersion tests were made under the following test conditions.

| | |
|---|---|
| Specimens: | Same as used in Example 1 |
| Testing solutions (4 kinds): | $H_2SO_4$, $H_2SO_4 + HNO_3$, $H_2SO_4 + Fe^{3+}$ ion, $H_2SO_4 + Cu^{2+}$ ion |
| Testing temp.: | 260° C. |
| Testing time: | 168 hours |

The above $HNO_3$ was continuously added to the $H_2SO_4$ at a feeding rate of 30 ml/hr, and the above $Fe^{3+}$ or $Cu^{2+}$ was added in the form of $Fe_2(SO_4)_3.9H_2O$ or $CuSO_4.5H_2O$ to the $H_2SO_4$ solution at the initial stage of the test to an extent that the amount of $Fe^{3+}$ or $Cu^{2+}$ amounted to 0.1 wt.%. After immersion in the solutions, the specimens were subjected to the same bend test as in Example 1. The results are that $Fe^{3+}$ and $Cu^{2+}$ as well as $HNO_3$ were found to be effective in preventing the hydrogen embrittlement of tantalum as indicated in Table 3.

TABLE 3

Effect of Ferric and Cupric Ions on Corrosion and Hydrogen Embrittlement of Tantalum in Metallic Ion-Containing Sulphuric Acid Boiling at 260° C.

| Test solution | Amount of hydrogen absorbed (ppm) | Bend test(4) | Corrosion Rate (mm/yr) |
|---|---|---|---|
| $H_2SO_4 + Fe^{3+}$(1) | 6.1 | ○ | 0.38 |
| $H_2SO_4 + HNO_3$(2) | 5.8 | ○ | 0.29 |
| $H_2SO_4 + Cu^{2+}$(3) | 5.4 | ○ | 0.33 |
| $H_2SO_4$ | 180 | ● | 0.61 |

Testing temp.: 260° C. Testing time: 168 hrs
(1)$Fe_2(SO_4)_3.9H_2O$ added initially only
(2)Continuous addition
(3)$CuSO_4.5H_2O$ added initially only
(4) ○: No cracks
●: Cracks occurred

EXAMPLE 3

The procedure of Example 1 was followed except than $HNO_3$ was added in an amount by weight of 3% at the time of start of the test without subsequent further addition thereof.

The result is that the one-time addition of 3 wt.% of $HNO_3$ at the time of start of the test unlike the cases of Examples 1 and 2 was found to be still effective in preventing hydrogen absorption even when the $HNO_3$ decreased to about 0.1 wt.% in concentration during the test as is seen from FIG. 3.

EXAMPLE 4

The procedure of Example 1 was followed except that $H_2SO_4$, $H_2SO_4+H_2O_2$, and $H_2SO_4+H_2O_2+HNO_3$ were each used as the test solution, the $H_2O_2$ was continuously added at a feeding rate of 20 ml/hr and the test continued for 168 hours. The $HNO_3$ was added at a feeding rate of 30 ml/hr as in Example 1.

RESULT OF THE TEST

In the decomposing reaction of radioactive resin wastes and radioactive sludges with sulphuric acid, hydrogen peroxide is effective in promoting the decomposing reaction (as disclosed in Japanese Pat. Appln. Laid-Open No. 53-88500), however, it was not appreciated to be effective in preventing hydrogen embrittlement and corrosion as indicated in the case of the solution (A) in Table 4. On the other hand, the addition of $HNO_3$ to the solution (A) was found to be effective in preventing hydrogen embrittlement and corrosion as shown in the case of the solution (B) in Table 4.

TABLE 4

Effect of $H_2O_2$ alone and $H_2O_2$ with $HNO_3$ on Corrosion and Hydrogen Embrittlement on Tantalum in Sulphuric Acid Boiling at 260° C.

| Test solution | Amount of hydrogen absorbed (ppm) | Corrosion rate (mm/yr) | Bend[1] test |
|---|---|---|---|
| $H_2SO_4 + H_2O_2$ (A) | 155 | 0.70 | ● |
| $H_2SO_4 + H_2O_2 + HNO_3$ (B) | 6.8 | 0.32 | ○ |
| $H_2SO_4$ (C) | 180 | 0.61 | ● |

[1] ○: Not cracked,
● : Cracked
Testing time: 168 hours
Testing temp.: 260° C.

What is claimed is:

1. A method for preventing the corrosion and hydrogen embrittlement of equipment made of tantalum handling therein hot concentrated sulphuric acid at 200° C. or higher, comprising incorporating in said hot concentrated sulphuric acid in contact with said tantalum at least one oxidizer selected from the group consisting of nitric acid, nitrogen oxides, ferric ion, cupric ion, stannic ion and plumbic ion.

2. A method according to claim 1, wherein the oxidizer is at least one metallic ion selected from the group consisting of ferric, cupric, stannic and plumbic ions which are derived from at least one salt of said metallic ion selected from the group consisting of sulphates, nitrates and chlorates.

* * * * *